US005916012A

United States Patent [19]

Pant et al.

[11] Patent Number: 5,916,012

[45] **Date of Patent: *Jun. 29, 1999**

[54] CONTROL OF CHEMICAL-MECHANICAL POLISHING RATE ACROSS A SUBSTRATE SURFACE FOR A LINEAR POLISHER

[75] Inventors: Anil K. Pant, Santa Cruz, Calif.; Joseph R. Breivogel, Aloha, Oreg.; Douglas W. Young, Sunnyvale; Robert M. Rivera, San Leandro, both of Calif.

[73] Assignee: Lam Research Corporation, Fremont, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,658

[22] Filed: Jun. 25, 1997

Related U.S. Application Data

[63] Continuation of application No. 08/638,462, Apr. 26, 1996, abandoned.

[51] Int. Cl.[6] ..... B35B 1/00; B35B 7/19

[52] U.S. Cl. ..... 451/41; 451/296; 451/303; 451/287

[58] Field of Search ..... 451/285, 286, 451/287, 288, 289, 41, 6, 5, 63, 456, 388, 364, 446, 490, 296, 299, 300, 303

[56] References Cited

U.S. PATENT DOCUMENTS

| | | | |
|---|---|---|---|
| 3,753,269 | 8/1973 | Budman | 15/160 |
| 5,205,082 | 4/1993 | Shendon et al. | 451/41 |
| 5,230,184 | 7/1993 | Bukhman | 451/41 |
| 5,232,875 | 8/1993 | Tuttle et al. | 437/225 |
| 5,246,525 | 9/1993 | Sato | 156/345 |
| 5,276,999 | 1/1994 | Bando | 51/62 |
| 5,297,361 | 3/1994 | Baldy et al. | 51/119 |
| 5,329,732 | 7/1994 | Karlsrud et al. | 51/131.5 |
| 5,329,734 | 7/1994 | Yu | 451/41 |
| 5,335,453 | 8/1994 | Baldy et al. | 451/173 |
| 5,575,707 | 11/1996 | Telieh et al. . | |

FOREIGN PATENT DOCUMENTS

| | | |
|---|---|---|
| 2-269553 | 2/1990 | Japan . |

*Primary Examiner*—Timothy V. Eley
*Assistant Examiner*—Derris Holt Banks

[57] ABSTRACT

A technique for controlling a polishing rate across a substrate surface when performing CMP, in order to obtain uniform polishing of the substrate surface. A support housing which underlies a polishing pad includes a plurality of openings for dispensing a pressurized fluid. The openings are arranged into a pre-configured pattern for dispensing the fluid to the underside of the pad opposite the substrate surface being polished. The openings are configured into a number of groupings, in which a separate channel is used for each grouping so that fluid pressure for each group of openings can be separately and independently controlled.

15 Claims, 7 Drawing Sheets

CONTROL OF CHEMICAL-MECHANICAL POLISHING RATE ACROSS A SUBSTRATE SURFACE FOR A LINEAR POLISHER

RELATED APPLICATION

This application is continuation to application titled "Control Of Chemical-Mechanical Polishing Rate Across A Substrate Surface;" Ser. No. 08/638,462; filed Apr. 26, 1996, now abandoned.

BACKGROUND OF THE INVENTION

1. Field of the Invention

The present invention relates to the field of semiconductor wafer processing and, more particularly, to chemical-mechanical polishing of semiconductor wafers.

2. Background of the Related Art

The manufacture of an integrated circuit device requires the formation of various layers (both conductive and non-conductive) above a base substrate to form the necessary components and interconnects. During the manufacturing process, removal of a certain layer or portions of a layer must be achieved in order to pattern and form various components and interconnects. Chemical mechanical polishing (CMP) is being extensively pursued to planarize a surface of a semiconductor wafer, such as a silicon wafer, at various stages of integrated circuit processing. It is also used in flattening optical surfaces, metrology samples, and various metal and semiconductor based substrates.

CMP is a technique in which a chemical slurry is used along with a polishing pad to polish away materials on a semiconductor wafer. The mechanical movement of the pad relative to the wafer in combination with the chemical reaction of the slurry disposed between the wafer and the pad, provide the abrasive force with chemical erosion to polish the exposed surface of the wafer (or a layer formed on the wafer), when subjected to a force pressing the wafer to the pad. In the most common method of performing CMP, a substrate is mounted on a polishing head which rotates against a polishing pad placed on a rotating table (see, for example, U.S. Pat. No. 5,329,732). The mechanical force for polishing is derived from the rotating table speed and the downward force on the head. The chemical slurry is constantly transferred under the polishing head. Rotation of the polishing head helps in the slurry delivery as well in averaging the polishing rates across the substrate surface.

A constant problem encountered in CMP processing is that the polishing rate around the periphery (edge) of the substrate is different than that for the interior (center) of the substrate. Various reasons account for this difference. Pad bounce being one cause. The polishing rate difference can also be caused by the variations in the velocity encountered in the rotational movement. The polishing rate may vary depending on the location on the pad where a particular area of the wafer is placed. Some amount of averaging is achieved by rotating the wafer (in some instances, oscillation is also used along with rotation), but polishing rate variations are still noticeable with rotating polishers, such variations resulting in non-uniform polishing across the wafer surface. Thus, an emphasis in CMP processing is to minimize this inequality in polishing rates.

One technique for obtaining a more uniform polishing rate is to utilize a linear polisher. Instead of a rotating pad, a moving belt is used to linearly move the pad across the wafer surface. The wafer is still rotated for averaging out the local variations, but the global planarity is improved over CMP tools using rotating pads. One such example of a linear polisher is described in a pending application titled "Linear Polisher And Method For Semiconductor Wafer Planarization;" Ser. No. 08/287,658; filed Aug. 9, 1994.

Unlike the hardened table top of a rotating polisher, linear polishers are capable of using flexible belts, upon which the pad is disposed. This flexibility allows the belt to flex and change the pad pressure being exerted on the wafer. The present invention takes this fact into consideration and uses this property to provide for localized pressure variations to be exerted at various locations of the wafer to control the force of the contact of the pad with the wafer in order to obtain a more uniform rate of polish across the wafer.

SUMMARY OF THE INVENTION

The present invention describes a technique for controlling a polishing rate across a substrate surface during polishing, in order to obtain uniform polishing of the substrate surface. A support housing which underlies a polishing pad includes a plurality of openings for dispensing a pressurized fluid. The openings are arranged into a pre-configured pattern for dispensing the fluid to the underside of the pad opposite the substrate surface being polished. The openings are configured into a number of groupings, in which a separate channel is used for each grouping so that fluid pressure for each group of openings can be separately and independently controlled.

The ability to control fluid pressure at various locations underlying the substrate permits localized pressure adjustments to ensure that the pad-substrate contact is maintained at desirable levels to ensure a uniform rate of polish across the whole of the surface being polished. In one embodiment, the openings are arranged in rows and in another embodiment the openings are arranged concentrically. Still in another embodiment, independent fluid pressure control is separated into quadrants so that force differences caused by a linear movement of a belt/pad assembly of a linear polisher are compensated. The invention can be practiced in a variety of polishing tools, however, the advantages are notable with a linear polisher when performing chemical-mechanical polishing (CMP).

DETAILED DESCRIPTION OF THE PREFERRED EMBODIMENTS

A method and apparatus for controlling a polishing rate across a substrate during chemical-mechanical polishing (CMP) in order to achieve uniform polishing of the substrate is described. In the following description, numerous specific details are set forth, such as specific structures, materials, polishing techniques, etc., in order to provide a thorough understanding of the present invention. However, it will be appreciated by one skilled in the art that the present invention may be practiced without these specific details. In other instances, well known techniques and structures have not been described in detail in order not to obscure the present invention. It is to be noted that a preferred embodiment of the present invention is described in reference to a linear polisher, however, it is readily understood that other types of polishers can be designed and implemented without departing from the spirit and scope of the present invention to practice the invention. Furthermore, although the present invention is described in reference to performing CMP on a semiconductor wafer, the invention can be readily adapted to polish other materials as well.

Figure 1:
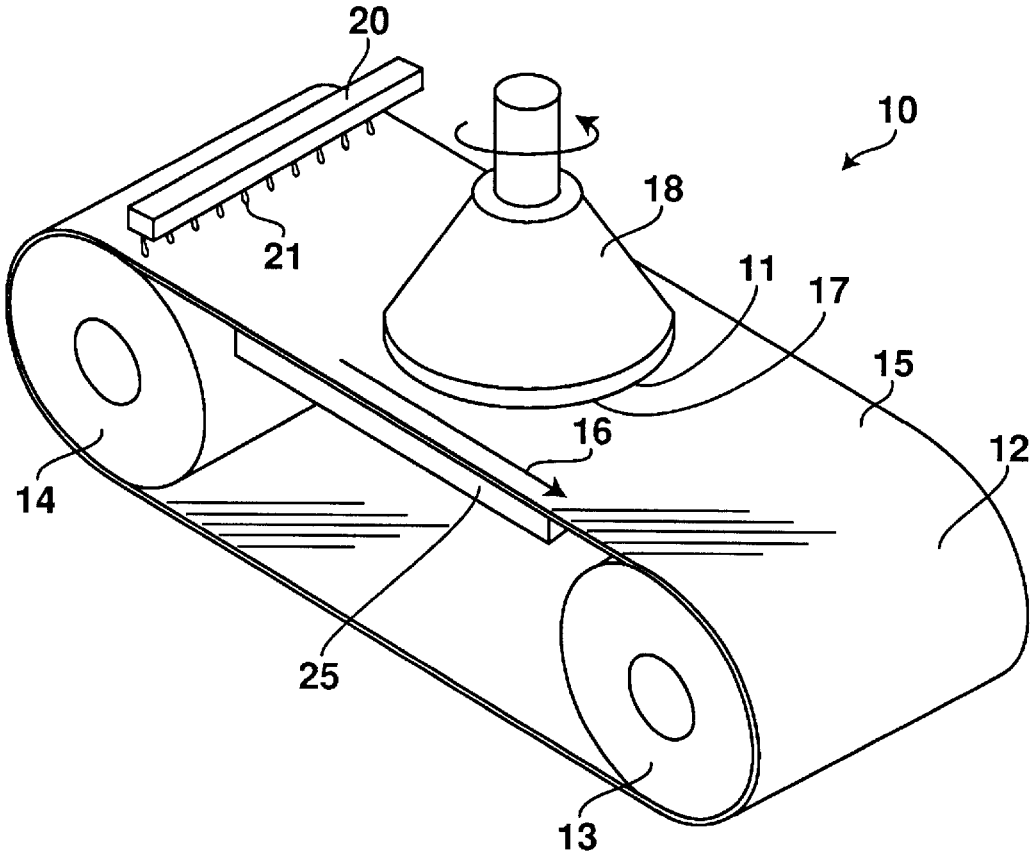
FIG. 1 is a pictorial illustration of a linear polisher for practicing the present invention.
Figure 2:
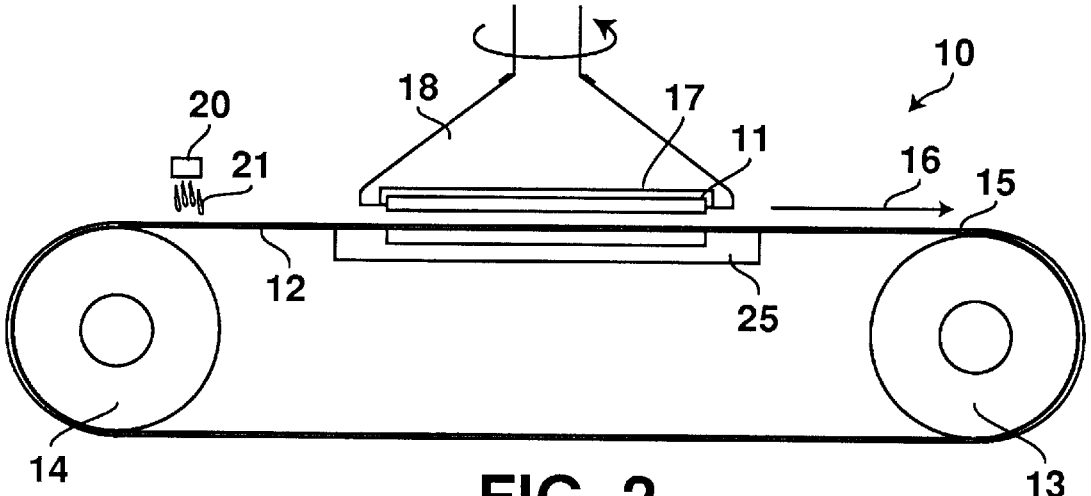
FIG. 2 is a cross-sectional diagram of the linear polisher of FIG. 1.

Referring to FIGS. 1 and 2, a linear polisher 10 for use in practicing the present invention is shown. The linear polisher 10 is utilized in polishing a semiconductor wafer 11, such as a silicon wafer, to polish away materials on the surface of the wafer. The material being removed can be the substrate material of the wafer itself or one of the layers formed on the substrate. Such formed layers include dielectric materials (such as silicon dioxide), metals (such as aluminum, copper or tungsten), metal alloys or semiconductor materials (such as silicon or polysilicon). More specifically, a polishing technique generally known in the art as chemical-mechanical polishing (CMP) is employed to polish one or more of these layers fabricated on the wafer 11, in order to planarize the surface layer. Generally, the art of performing CMP to polish away layers on a wafer is known and prevalent practice has been to perform CMP by subjecting the surface of the wafer to a rotating platform (or platen) containing a pad (see for example, the Background section above). An example of such a device is illustrated in the afore-mentioned U.S. Pat. No. 5,329,732.

The linear polisher 10 is unlike the rotating pad device in current practice. The linear polisher 10 utilizes a belt 12, which moves linearly in respect to the surface of the wafer 11. The belt 12 is a continuous belt rotating about rollers (or spindles) 13 and 14, which rollers are driven by a driving means, such as a motor, so that the rotational motion of the rollers 13–14 causes the belt 12 to be driven in a linear motion with respect to the wafer 11, as shown by arrow 16. A polishing pad 15 is affixed onto the belt 12 at its outer surface facing the wafer 11. Thus, the pad 15 is made to move linearly relative to the wafer 11 as the belt 12 is driven.

The wafer 11 is made to reside within a wafer carrier 17, which is part of housing 18. The wafer 11 is held in position by a mechanical retaining means (such as a retainer ring) and/or by vacuum. How the wafer 11 is retained in the carrier 17 is not critical to the understanding of the present invention. What is important is that some type of a wafer carrier be used to position the wafer atop the belt 12 so that the surface of the wafer to be polished is made to come in contact with the pad 15. It is preferred to rotate the housing 18 in order to rotate the wafer 11. The rotation of the wafer 11 allows for averaging of the polishing contact of the wafer surface with the pad 15. An example of a linear polisher is described in the afore-mentioned pending patent application titled "Linear Polisher And Method For Semiconductor Wafer Planarization."

Furthermore, for the linear polisher 10 of the preferred embodiment, there is a slurry dispensing mechanism 20, which dispenses a slurry 21 onto pad 15. The slurry 21 is necessary for proper CMP of the wafer 11. A pad conditioner (not shown in the drawings) is typically used in order to reconditioned the pad during use. Techniques for reconditioning the pad during use are known in the art and generally require a constant scratching of the pad in order to remove the residue build-up caused by the used slurry and removed waste material. One of a variety of pad conditioning or pad cleaning devices can be readily adapted for use with linear polisher 10.

The linear polisher 10 of the preferred embodiment also includes a platen 25 disposed on the underside of belt 12 and opposite from carrier 17, such that belt 12 resides between platen 25 and wafer 11. A primary purpose of platen 25 is to provide a supporting platform on the underside of the belt 12 to ensure that the pad 15 makes sufficient contact with wafer 11 for uniform polishing. Typically, the carrier 17 is pressed downward against the belt 12 and pad 15 with appropriate force, so that wafer 11 makes sufficient contact with pad 15 for performing CMP. Since the belt 12 is flexible and will depress when the wafer is pressed downward onto the pad 15, platen 25 provides a necessary counteracting force to this downward force. Also, due to the flexibility of the belt 12, there is some belt sag between the rollers 13–14 (even without the weight of the wafer). Accordingly, the belt 12 may introduce polishing rate variations, simply due to the physical nature of the belt 12.

Although platen 25 can be of a solid platform, a preference is to have platen 25 function as a type of fluid bearing for the practice of the present invention. One example of a fluid bearing is described in a pending US Patent application titled "Wafer Polishing Machine With Fluid Bearings;" Ser. No. 08/333,463; filed Nov. 2, 1994 (now U.S. Pat. No. 5,558,568, which is assigned to the Assignee of this application). This pending application describes fluid bearings having pressurized fluid directed against the polishing pad. An example is given in which concentric fluid bearings provide a concentric area of support. The present invention is an enhancement (or improvement) to the afore-mentioned fluid bearings. Corrections obtained from the fluid pressure adjustments of the present invention compensate for polish variations caused due to the linear movement and flexibility of the belt, as well as wafer surface irregularity. That is, the fluid pressure adjustments in the present invention are performed to compensate for the flexibility of the belt, the linear translation of the belt across the wafer surface and any other irregularities introduced.

Figure 3:
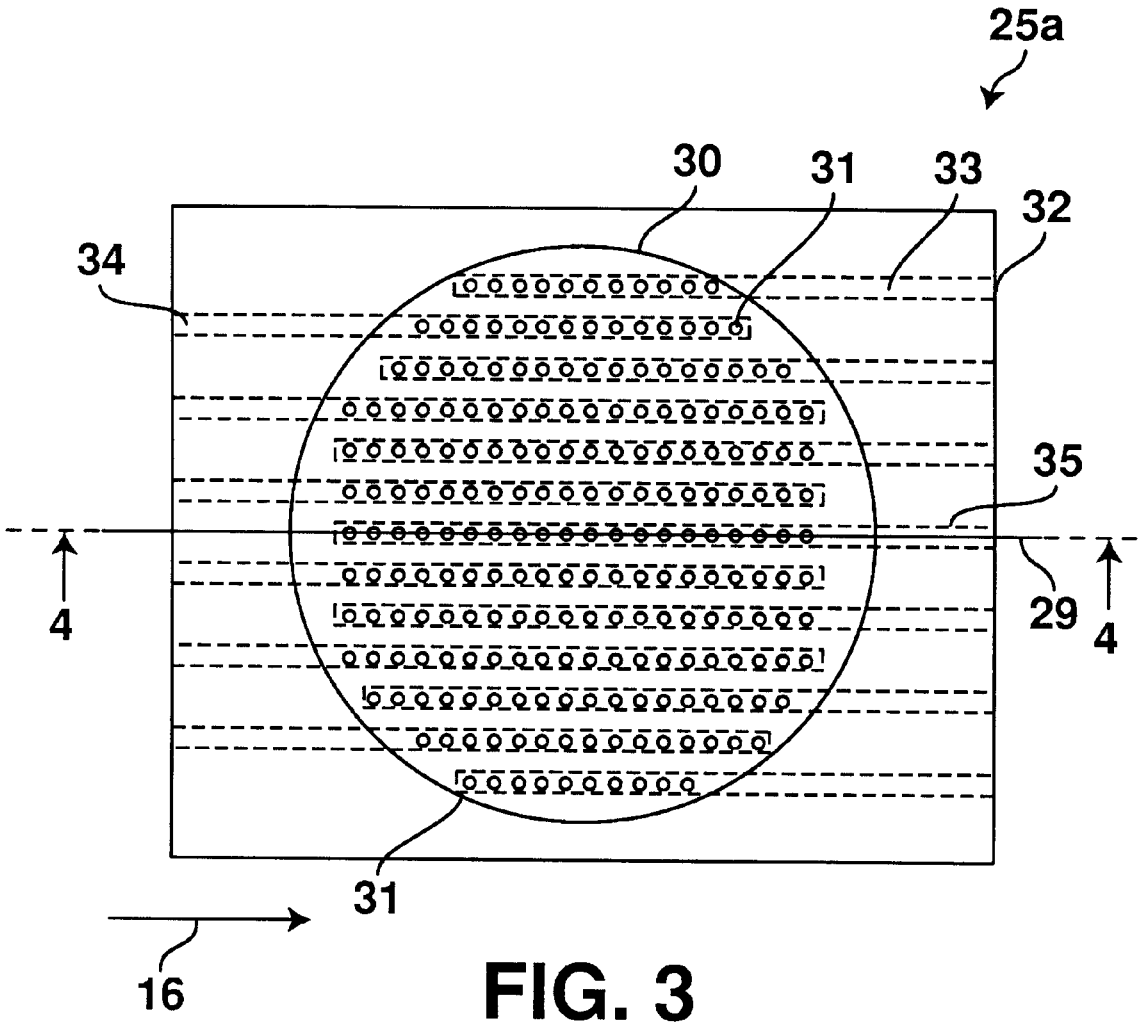
FIG. 3 is a top plan view of a platen of the present invention in which fluid dispensing and drainage openings are arranged in rows.
Figure 4:
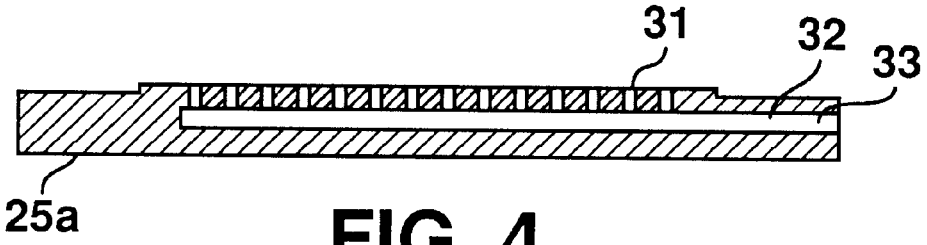
FIG. 4 is a cross-sectional view of the platen of FIG. 3.

Referring to FIGS. 3 and 4, one embodiment of a fluid platen for practicing the present invention is shown. A platen 25*a* functions equivalently to platen 25 in that it is positioned to provide support to the underside of belt 12 opposite carrier 17. A circular center section 30 of platen 25*a* is positioned directly opposite wafer 11 to oppose the downward pressing force of the wafer 11 onto pad 15. The actual size of the center section 30 corresponds to the size of the wafer. Thus, if the wafer is 200 mm in diameter, than circular section 30 will be at least 200 mm in diameter so that it can fully oppose the wafer 11.

Within this center section 30, a series of openings 31 are formed, arranged in parallel rows 32. In the embodiment of FIGS. 3–4, the rows are disposed in the direction of belt travel (rows are parallel to direction 16). For each row 32 of openings 31, a fluid channel 33 or 34 is disposed under the openings 31. Channel 33 is a dispensing channel for dispensing a pressurized fluid. The pressurized fluid is forced through openings 31 of channel 33 and is then forced against the underside of belt 12. Channel 34 is a drain channel for collecting spent fluid from the surface of platen 25*a* through openings 31 of channel 34. In the preferred design of FIG. 3, the openings 31 associated with center row 35 are coupled to one of the dispensing channels 33. Adjacent rows to the center row 35 provide for drainage and the rows of openings alternate as dispensing and drainage openings thereafter to the periphery of the center section 30. Thus, in FIG. 3, seven dispensing channels 33 and six drainage channels 34 are shown.

It is appreciated that it is the presence of the fluid dispensing channels 32 and their corresponding openings 31 which are the required structures for the practice of the present invention. The use of the drainage channels 34 and their corresponding openings 31 provide for sufficient drainage of the spent fluid, however, the invention will operate with other drainage schemes as well. For example, there may not be any drainage openings within the center section 30 altogether. In that event, the drainage can be obtained by fluid run-off at the periphery of the platen 25*a*.

It is appreciated that each of the dispensing channels 33 can be controlled independently to dispense fluid at a particular pressure. Accordingly, where the belt 12 traverses linearly across the surface of the wafer 11, a variety of pressure profiles can be achieved by controlling the fluid pressure in each of the channels 33 in order to obtain uniform polishing across the surface of wafer 11. Since the variations in the contact force between the pad 15 and the wafer surface will cause variations in the polishing rate of the wafer 11, the fluid pressure exerted on the underside of the belt 12 at appropriate regions will compensate for the variation. The fluid compensation is achieved for each linear region associated with a particular fluid dispensing row 32. Accordingly, the degree of control will depend partly on the number of such rows 32 are present for dispensing the fluid.

The degree of control and adjustments available will depend on a number of factors, including the number of channels 33, the number and size of openings 31, linear speed of the belt, rotational speed of the wafer, height of the active center section 30, platen height, platen alignment and particularly the flow rate and pressure of the fluid being dispensed. In the embodiment shown in FIGS. 3–4, the openings 31 are approximately 0.020 inch in diameter and coupled to channels, each of which are formed from a ¼ inch diameter tubing. However, it is appreciated that these dimensions and shapes of openings 31 are a design choice dictated by the particular design of the polisher.

Figure 5:
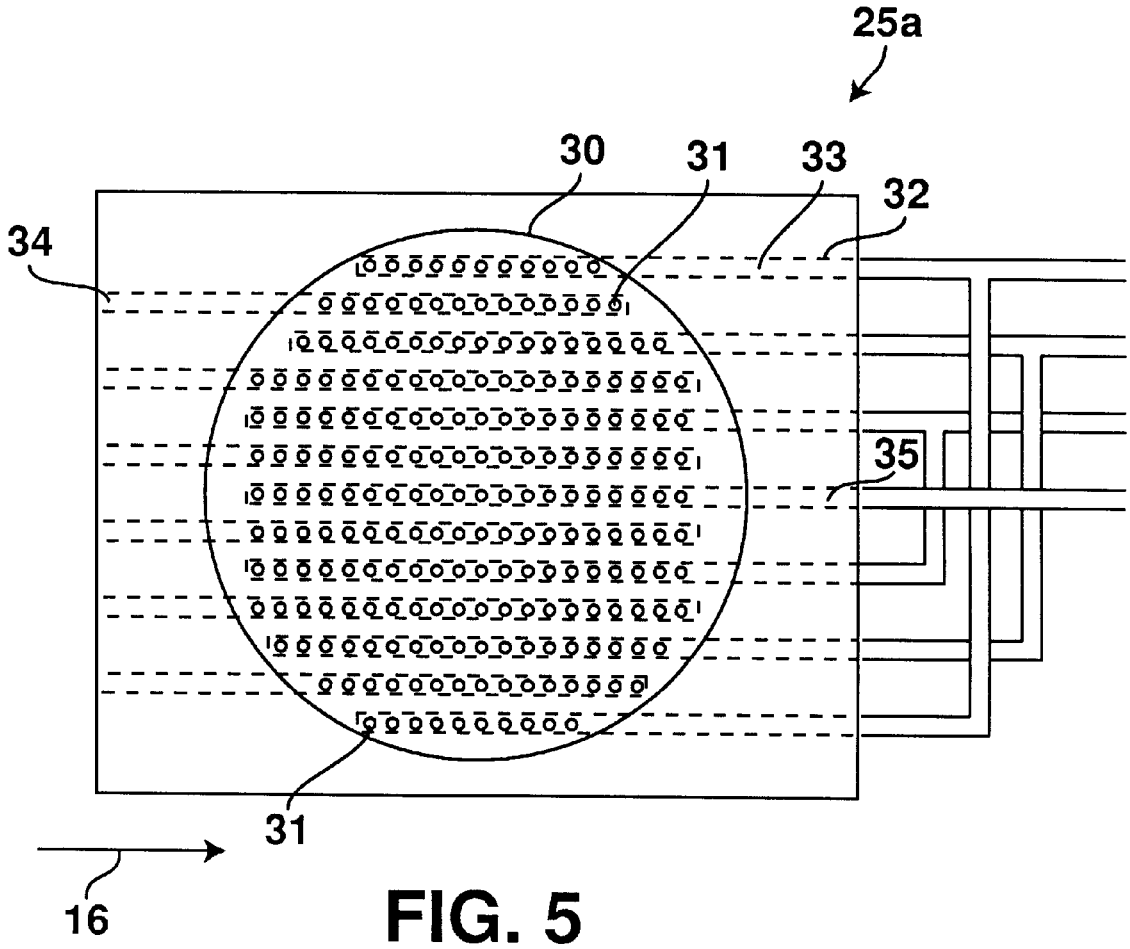
FIG. 5 is a top plan view of the platen of FIG. 3 in which symmetrically arranged pairs of dispensing channels are coupled together.

In situations where such a degree of independent adjustment is not desired, an alternative technique is to couple symmetrical pairs of dispensing channels 33. That is, as shown in FIG. 5, each symmetrical pair of dispensing channels 33 outbound from the center row 35 are coupled together. The center channel 35 still remains singular. Accordingly, the pairs of channels which are coupled together will have the same fluid pressure. Since the wafer is rotated relative to the linear movement of the pad 15, any differences in the polish rate at two symmetrically opposite points (symmetrically opposite from central axis 29), are generally averaged out. Thus, this alternative technique of pairing the symmetrically opposite channels allows for achieving uniform polish rate with less number of fluid pressure control units, which are required for controlling each separate fluid pressure. It is to be noted that drainage channels 34 can all be coupled together to a single drain. It is also to be noted that drainage openings are not required. The spent fluid (if liquid) can run off the edge of the platen 25*a*.

Figure 6:
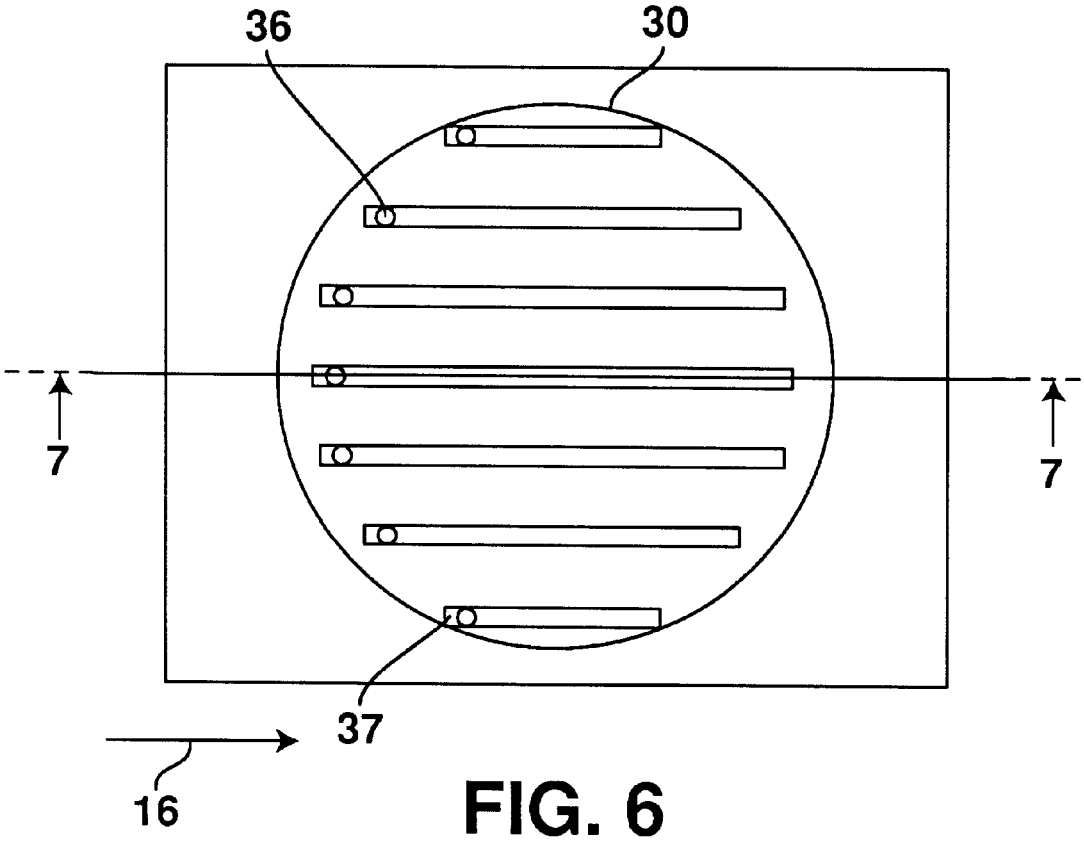
FIG. 6 is a top plan view of a platen of another embodiment of the present invention in which fluid dispensing openings are arranged in rows, but the openings are long slits instead of circular holes.
Figure 7:
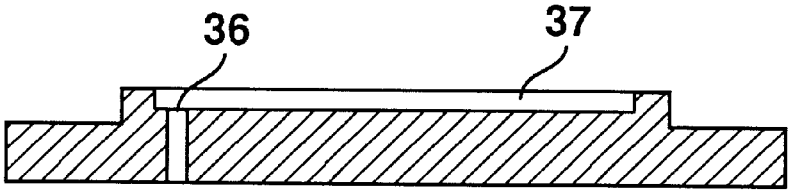
FIG. 7 is a cross-sectional view of the platen of FIG. 6.

It is appreciated that although the openings 31 are circular in the platen 25*a* of FIGS. 3–5, the shape of the dispensing opening 31 is a design choice. Furthermore, the number of such openings is also dictated by the system design. The channels are shown having their ends at the sides of the platen, but such ends (where fluid is plumbed) can be located at the bottom surface as well. Accordingly, as shown in FIGS. 6 and 7, the dispensing openings for platen 25*c* can be a singular elongated slit 37 for each of the fluid dispensing rows. The slits 37 effectively function as fluid channels as well in dispensing the fluid. No drainage openings are disposed on the platen 25*c*. Rather, the drainage of the fluid (if liquid) is achieved as a run-off at the edge of the platen 25*c*. Fluid is introduced into each slit 37 through an opening 36 located at the bottom of the platen 25*c*. The pairing of the symmetrical rows of slits 37, similar to the channels of FIG. 5, can be implemented as well if so desired.

Accordingly, when non-uniform polishing rate of the wafer surface occurs due to the nature of the flexible and moving belt, variations encountered at center-edge location differences of the wafer and/or from any other cause, adjustment of the fluid pressure at appropriate locations will compensate to increase or decrease pad-wafer contact at these points, resulting in a more uniform polishing rate. Ironically, it is the flexibility of the belt which allows compensating adjustments to be made to the belt by controlling the fluid pressure at various desired locations. Accordingly, a technique to compensate for non-uniform polishing rates encountered on the wafer surface is to exert varying upward compensating (or counteracting) forces on the underside of the belt, so that the forces exerted by the pad onto the wafer is of such value at various locations of the wafer surface, in order to obtain a uniform polishing rate of the wafer. Platens 25*a* and 25*c* described above are just two examples of how this can be achieved. Platens described below also perform the same function, but by a different configuration.

Figure 8:
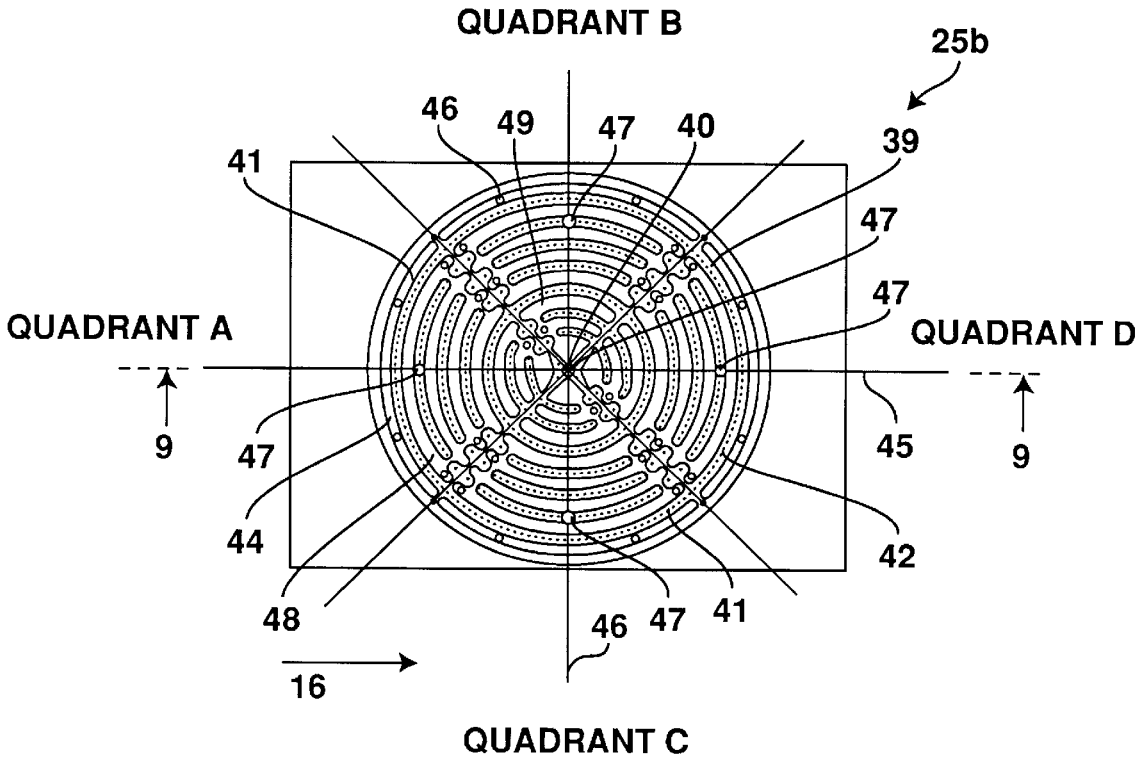
FIG. 8 is a top plan view of a platen of another embodiment of the present invention in which fluid dispensing openings are arranged in concentric circles, but grouped into quadrants, and in which gap sensors are installed at various locations across the surface of the platen.
Figure 9:
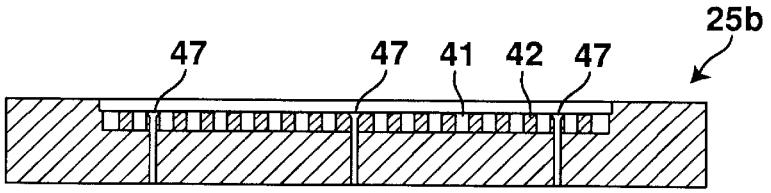
FIG. 9 is a cross-sectional view of the platen of FIG. 8.

Referring to FIGS. 8 and 9, an alternative embodiment of the present invention is shown in platen 25*b*. Platen 25*b* is designed having four quadrants A–D, wherein quadrant A is the leading edge quadrant respective to the linear motion of the belt 12, as shown by the arrow 16. Platen 25*b* also provides the above described compensating forces by having concentrically arranged fluid openings separated into the four quadrants A–D. As shown in FIG. 8, the leading edge quadrant is designated A, the trailing edge as quadrant D and the other two middle regions, quadrants B and C. Essentially, since the active section of platen 25*b* is the central circular section 30, corresponding to the circular wafer 11, the four quadrants can each be described by analogy as a quarter of a "pie" section (A–D). As noted, sections B and C are symmetrical (about a horizontal axis 45) with respect to the direction of the linear motion 16 of the belt 12.

As shown in FIG. 8, a plurality of channels 41 are arranged concentrically about the center 40 (which corresponds with the center of the overlying wafer 11). The channels 41 are equivalent to dispensing channels 33 earlier described in FIG. 3, but in this instance are arranged in concentric rows, instead of linear rows. The concentrically arranged channels are separated by elevated areas 42 of platen 25*b*, also concentrically arranged. Stated differently, the elevated areas 42 are formed as part of the platen 25*b* and in which depressed (lower) regions between the elevated areas 42 form the channels 41. As noted in FIG. 8, the elevated areas separate the channels of the four quadrants, as well as the quadrants themselves.

Although each channel in a quadrant can be designed to have independent fluid pressure control, the embodiment of FIG. 8 couples some of the adjacent channels together in to a channel group. Thus, platen 25*b* is designed to have three concentrically arranged groups of channels for each quadrant. The outer channel grouping 44 is comprised of an outer channel only. The middle channel grouping 48 is comprised of four adjacent channels inward from the outer grouping. The inner channel grouping 49 is comprised of the remaining channel regions (three in this example) inward from the middle grouping 48. Accordingly, the embodiment shown as platen 25*b* will have twelve (three groupings X four quadrants) independently controlled channel regions.

Fluid is introduced into each channel grouping via an opening 46 located at the bottom of the channel. The number of such openings 46 is a design choice, but there must be one fluid opening 46 for each of the twelve independent channel regions. Fluid flow rate and pressure for each channel region can be independently controlled. However, when desired, some channel regions can be coupled together, as noted earlier. For example, the three symmetrically opposite regions of quadrants B and C could be coupled together, somewhat similar to the arrangement described for platen 25*a* in FIG. 5. Although not necessary, fluid drainage openings 39 are shown atop the elevated area 42. Again, it is appreciated that such drainage openings 39 need not be disposed on platen 25*b*, since fluid (if liquid) run-off can be at the edge of the platen 25*b*.

Figure 10:
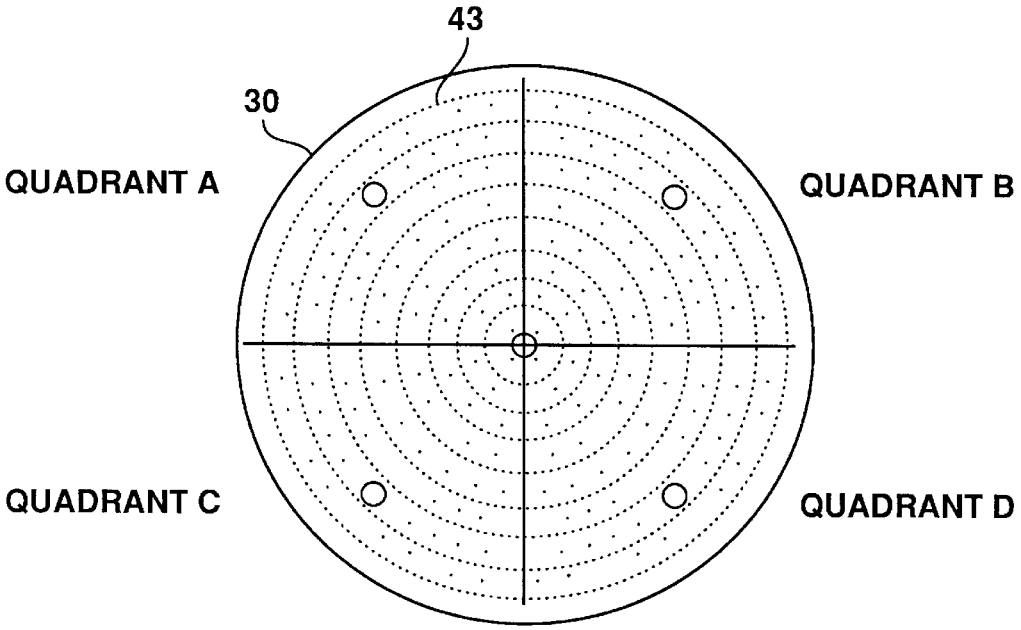
FIG. 10 is a top plan view of an insert which is used with the platen of FIG. 8, in which the insert containing a particular hole pattern can be interchanged on the platen to provide different fluid dispensing profiles.

Referring also to FIG. 10, a platen insert 38 is shown. Platen insert 38 is placed atop platen 25*b* in order to cover the channels 41. In the example, insert 38 is made circular so that it fits into a recess formed along the outer edge of the circular operative region of platen 25*b* and forms a covering over the channels 41. The insert 38 is manufactured to have a particular hole pattern, which hole openings 43 correspond to reside atop the channels 41. The fluid is dispensed to the underside of the belt 12 through these openings 43. By utilizing an insert, such as insert 38, the platen 25*b* can accommodate different inserts, each with a particular hole pattern. Thus, different hole patterns can be disposed above the channels 41 without changing the platen itself.

As can be appreciated, if drain openings 39 are present, then openings must be present on the insert 38 to allow for the spent fluid to drain. Alternatively, an insert can be designed to cover only the channels 41 and not the drain openings 39. In such instance, insert 38 would have open regions coinciding with the elevated area 42, so that only the channels 41 are covered. It is also appreciated that the platen 25*b* can be manufactured so as not to require an insert. That is, the insert 38 becomes the upper surface of the active region of platen 25*b*.

Additionally, in order to obtain monitoring of the polishing process, platen 25*b* incorporates a number of sensors 47, which are disposed at various locations to monitor the proximity of the underside of the belt relative to the platen 25*b* surface. In the example shown in FIGS. 8–10 five sensors 47 are disposed, one at the center 40 and one each within each quadrant A–D. Although a variety of sensors can be used to monitor the separation between each sensor 47 and the underside of the belt 12, the preferred embodiment utilizes a proximity gap sensor to measure the gap separating the sensor (which is located at or near the surface of the platen 25*b* facing the underside of the wafer) and the belt. An example of such a gap sensor is a Linear Proximity Sensor, Model Type E2CA, manufactured by Omron Corporation.

Each gap sensor 47 monitors the gap separation between it and the belt. Through experimentation, ideal gap distances at various sensor locations are determined for each type of linear polisher system for achieving a uniform rate of polish across the wafer surface. Once these values are determined for a system, the sensors are used to maintain these desired values. Thus, when a particular sensor senses a gap distance which is out of tolerance, the fluid pressure for corresponding fluid dispensing openings monitored by that sensor are adjusted in order to bring the gap distance within tolerance. Insert 38 of FIG. 10 has openings to accommodate the five sensors 47.

Figure 11:
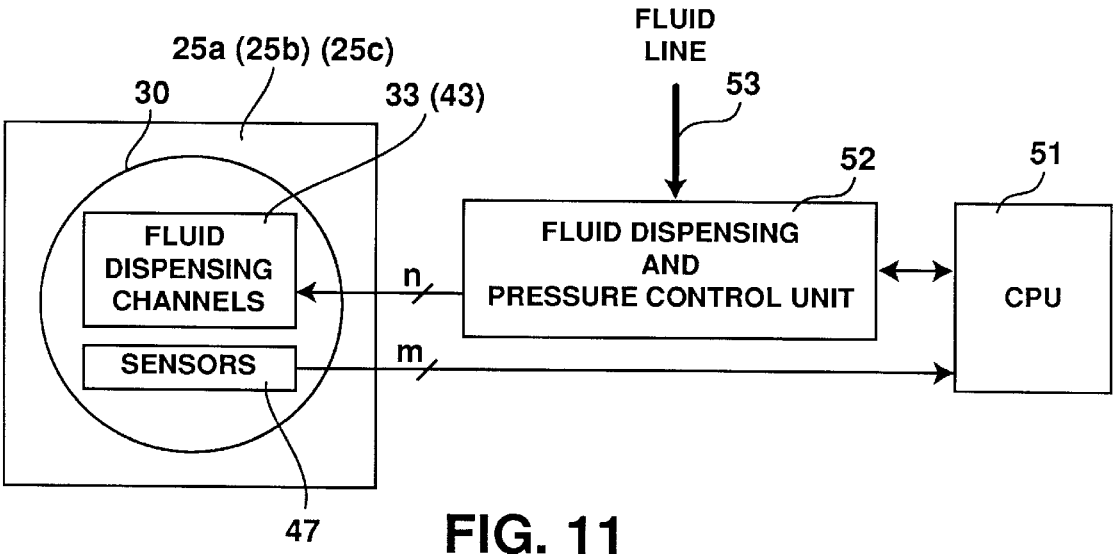
FIG. 11 is a block schematic diagram of a polishing tool incorporating the platens of the present invention in which automated processing and fluid control are used to respond to sensor inputs.

Accordingly, as shown in a block diagram in FIG. 11, a linear polishing CMP tool 50 is shown having a platen (such as one of the described platens for practicing the present invention), in which multiple fluid channels 33 or 41 are formed within the platen, along with a number of sensors 47. A main fluid line 53 is coupled to a fluid dispensing and pressure control unit 52. The fluid dispensing and pressure control unit 52 separates the fluid flow into n number of independent dispensing channels, each channel having a mechanism (such as a valve) for controlling the fluid pressure in that channel. A processor 51 (shown in the Figure as a CPU) is coupled to the fluid control unit 52 for controlling each of the fluid pressures. Sensors, such as sensors 47, monitor a parameter (such as the gap separation in the example) which is associated with the monitoring of uniform polishing and transmits the sensors' readings to CPU 51. Whenever system parameters are out of tolerance, the CPU 51 issues commands to the fluid control unit 52 to adjust the fluid pressure(s) to compensate. Thus, automated fluid modulation and compensation can be achieved. Furthermore, when the system is in use polishing a wafer in-situ correction can be performed, wherein sensor feedback permits automated correction of the various independently controlled fluid lines.

Figure 12:
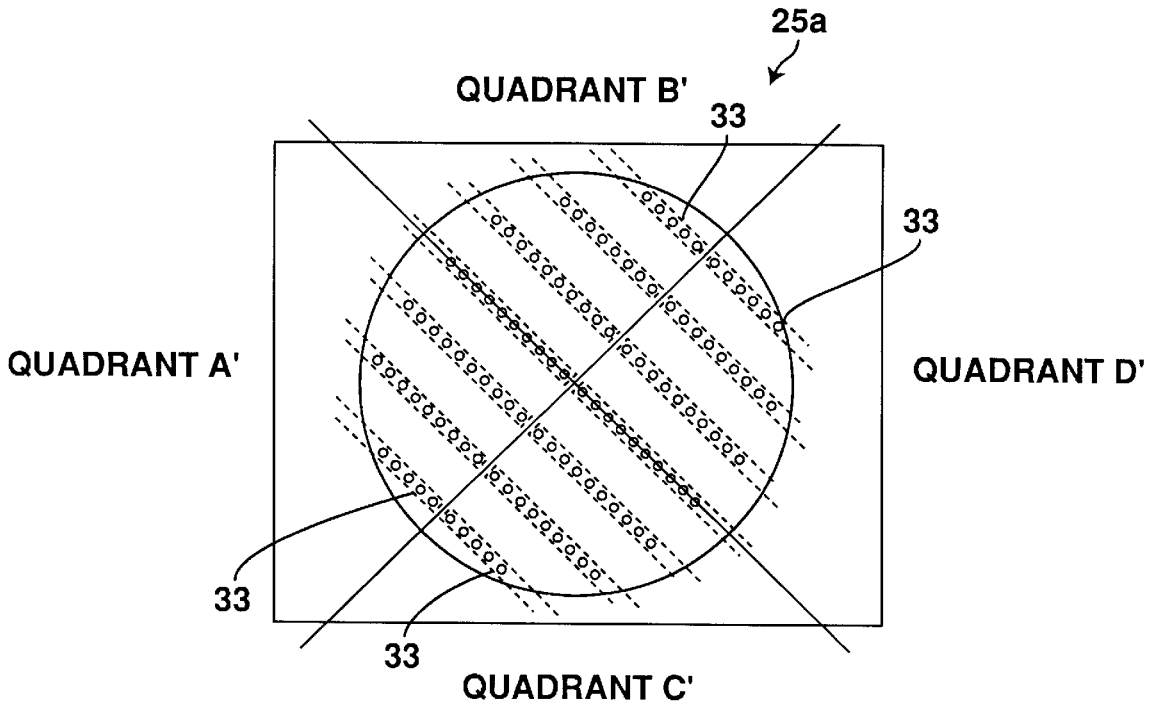
FIG. 12 is a top plan view of the platen of FIG. 3, but in which the fluid dispensing openings are grouped into quadrants for additional independent fluid dispensing control.

In reference to FIG. 12, a sectioned version of the platen 25*a* of FIG. 3 is shown. It is to be appreciated that the sectioning of the active center area 30 of the platen 25*b* of FIG. 8, as well as the inclusion of sensors 47, can be readily adapted to the linear row design of platen 25*a* of FIG. 3. In FIG. 12, only dispensing channels and openings are shown separated into quadrants A'–D'. Accordingly, channels for each row (or symmetrical pair of rows as noted in FIG. 5) are further separated into independent channels by quadrants. It is to be noted that the openings can be of slit type opening noted in FIG. 6, as well.

Thus, a platen for providing varying fluid pressure to the underside of a polishing pad at various selected locations to achieve a more uniform polishing rate of the material being polished is described. The fluid pressure at each local region under independent control can be adjusted independently. Therefore, a variety of pressure profiles can be obtained. A primary purpose being to achieve a more uniform polish rate across the material surface.

It is appreciated that the dispensing fluid can be either a liquid or a gas. Water would be the preferred fluid, if liquid is used. However inert gases can also accomplish similar results. An advantage of using water is cost. An advantage of using an inert gas, such as compressed air or nitrogen, is that no drainage is necessary.

It is to be noted that the platen can be manufactured from a variety of materials which can provide adequate support for the belt assembly. Such materials for fabricating the platen include aluminum, aluminum bronze, stainless steel, silicon carbide and other ceramics. The CMP tool implementing the present invention can also include a processor and automated controls described in reference to FIG. 11, or such processor can be external to the tool. For example, a stand-alone computer external to the tool can provide the necessary processing.

Also, it is appreciated that although the present invention is described in reference to the use of a linear polisher, it could readily be adapted for the circular polisher as well, provided that the pad or pad support is made flexible, so that the fluid pressure changes can modulate the force exerted from the underside of the pad. Finally, it is to be noted that the present invention can be used to polish other materials and need not be limited to silicon semiconductor wafers and layers formed on such wafers. Other materials, including substrates for the manufacture of flat panel displays can utilize the present invention.

We claim:

1. In a linear polishing tool utilized to polish a material having a planar surface and in which said planar surface is placed upon a linearly moving polishing pad for polishing said planar surface, an apparatus disposed on an underside of said polishing pad opposite said material for adjusting a polishing profile comprising:

a support disposed along the underside of said pad for providing support to said pad as said pad travels across said planar surface in a linear direction;

a plurality of fluid channels disposed in said support and arranged in a plurality of concentric rings for receiving pressurized fluid and dispensing said pressurized fluid against the underside of said pad, wherein said fluid exerts a counteracting force against a force pressing said material onto said pad;

said channels being partitioned into a number of concentric groupings so that each concentric grouping of channels has its fluid pressure adjusted independently from other of the concentric groupings; and said channels being further partitioned into a number of pie-shaped sections which emanate radially from their center, wherein each said section of said channels has its fluid pressure adjusted independently from other of said sections, such that independent fluid pressure adjustment is made for said channels corresponding to the concentric grouping and pie-shaped sections, said independent adjustment of said concentric groupings allowing for polishing profile control based on a radial distance from the center and independent adjustment of said sections allowing for polishing profile control in a circular arc about the center;

a covering disposed over said channels in which openings are disposed to correspond to said channels for dispensing said pressurized fluid from said channels through said openings to the underside of said pad.

2. The apparatus of claim 1 wherein said sections are comprised of four pie-shaped quadrant sections.

3. The apparatus of claim 1 wherein said fluid is a liquid.

4. The apparatus of claim 1 wherein said fluid is a gas.

5. In a chemical-mechanical polishing (CMP) tool in which a polishing pad is positioned on a continuously moving belt and utilized to polish a surface of a semiconductor wafer placed onto said pad moving in a linear direction on said belt, an apparatus disposed on an underside of said belt opposite said wafer for adjusting a polishing profile comprising:

a support disposed along the underside of said belt;

a plurality of fluid channels disposed in said support and arranged in a plurality of concentric rings for receiving pressurized fluid and dispensing said pressurized fluid against the underside of said belt, wherein said fluid exerts a counteracting force against a force pressing said wafer onto said pad;

said channels being partitioned into a number of concentric groupings so that each concentric grouping of channels has its fluid pressure adjusted independently from other of the concentric groupings; and said channels being further partitioned into a number of pie-shaped sections which emanate radially from their center, wherein each said section of said channels has its fluid pressure adjusted independently from other of said sections, such that independent fluid pressure adjustment is made for said channels corresponding to the concentric grouping and pie-shaped sections, said independent adjustment of said concentric groupings allowing for polishing profile control based on a radial distance from the center and independent adjustment of said sections allowing for polishing profile control in a circular arc about the center;

a covering disposed over said channels in which openings are disposed to correspond to said channels for dispensing said pressurized fluid from said channels through said openings to the underside of said belt.

6. The apparatus of claim 5 wherein said sections are comprised of four pie-shaped quadrant sections.

7. The apparatus of claim 5 wherein said fluid is a liquid.

8. The apparatus of claim 5 wherein said fluid is a gas.

9. A chemical-mechanical polishing (CMP) tool for polishing a layer formed on a semiconductor wafer comprising:

a carrier for holding said semiconductor wafer;

a linear belt having a pad disposed thereon for continuously moving in a linear direction relative to said wafer when said wafer is placed on said pad to perform CMP on said layer;

a support disposed along an underside of said belt for providing fluid pressure to support said belt and pad when said pad engages said wafer;

said support including a plurality of fluid channels disposed in said support and arranged in a plurality of concentric rings for receiving pressurized fluid and dispensing said pressurized fluid against the underside of said belt, wherein said fluid exerts a counteracting force against a force pressing said wafer onto said pad;

said channels being partitioned into a number of concentric groupings so that each concentric grouping of channels has its fluid pressure adjusted Independently from other of the concentric groupings; and said channels being further partitioned into a number of pie-shaped sections which emanate radially from their center, wherein each said section of said channels has its fluid pressure adjusted independently from other of said sections, such that independent fluid pressure adjustment is made for said channels corresponding to the concentric grouping and pie-shaped sections, said independent adjustment of said concentric groupings allowing for polishing profile control based on a radial distance from the center and independent adjustment of said sections allowing for polishing profile control in a circular arc about the center;

a covering disposed over said channels in which openings are disposed to correspond to said channels for dispensing said pressurized fluid from said channels through said openings to the underside of said belt.

10. The CMP tool of claim 9 wherein said sections are comprised of four pie-shaped quadrant sections.

11. A method of polishing a layer formed on a semiconductor wafer, comprising the steps of:

providing a linear belt having a pad disposed thereon and in which said belt and pad are continuously moving in a linear direction relative to said wafer when said wafer is placed on said pad;

providing a support disposed along an underside of said belt for providing fluid pressure to support said belt and pad when said pad engages said wafer;

providing a plurality of fluid channels disposed in said support and arranged in a plurality of concentric rings for dispensing of pressurized fluid, said channels being partitioned into a number of concentric groupings and being further partitioned into a number of pie-shaped sections which emanate radially from their center;

providing separate fluid dispensing controls for separate concentric groupings of each of the sections;

placing a covering over said channels, but having openings overlying said channels to dispense fluid to the underside of said belt;

dispensing said pressurized fluid through said openings;

adjusting fluid pressure for said openings corresponding to the concentric grouping and sectioning of said channels to separately control polishing profile of the wafer based on radial distance from the center and also based on a circular arc about the center.

12. The method of claim 11 wherein said polishing is achieved by a chemical-mechanical polishing (CMP) technique.

13. The method of claim 12 wherein said layer being polished is a dielectric layer.

14. The method of claim 12 wherein said layer being polished is a metal or metal alloy layer.

15. The method of claim 12 wherein said layer being polished is of a semiconductor material.

* * * * *